US009382098B2

(12) United States Patent
Arai et al.

(10) Patent No.: US 9,382,098 B2
(45) Date of Patent: Jul. 5, 2016

(54) ELEVATOR DEVICE AND ROLLER GUIDE ASSEMBLY

(75) Inventors: Hideki Arai, Inba-gun (JP); Takami Koyama, Hitachi (JP); Tsuyoshi Sekine, Tenshin-shi (CN); Hideki Nakano, Sakura (JP); Kota Ojima, Higashi-osaka (JP)

(73) Assignee: Nippon Otis Elevator Company, Tokyo (JP)

( * ) Notice: Subject to any disclaimer, the term of this patent is extended or adjusted under 35 U.S.C. 154(b) by 100 days.

(21) Appl. No.: 14/130,789

(22) PCT Filed: Jun. 26, 2012

(86) PCT No.: PCT/JP2012/066227

§ 371 (c)(1),
(2), (4) Date: Jan. 3, 2014

(87) PCT Pub. No.: WO2013/005605

PCT Pub. Date: Jan. 10, 2013

(65) Prior Publication Data

US 2014/0158473 A1 Jun. 12, 2014

(30) Foreign Application Priority Data

Jul. 6, 2011 (JP) ..... 2011-149628

(51) Int. Cl.
*B66B 7/04* (2006.01)

(52) U.S. Cl.
CPC . *B66B 7/04* (2013.01); *B66B 7/046* (2013.01); *B66B 7/048* (2013.01)

(58) Field of Classification Search
CPC ..... B66B 7/042; B66B 7/046; B66B 7/048; F16C 27/066
USPC ..... 187/410, 406; 384/536
See application file for complete search history.

(56) References Cited

U.S. PATENT DOCUMENTS

| | | | | | |
|---|---|---|---|---|---|
| 2,100,169 | A | * | 11/1937 | Norton | 187/406 |
| 2,260,922 | A | * | 10/1941 | Spiro | 187/410 |
| 3,043,401 | A | * | 7/1962 | Hallene et al. | 187/272 |
| 3,099,334 | A | * | 7/1963 | Tucker, Jr. | 187/406 |
| 3,415,500 | A | * | 12/1968 | Pethis | 261/29 |
| 3,856,117 | A | * | 12/1974 | Solymos | 187/406 |
| 3,961,829 | A | * | 6/1976 | Bowen et al. | 384/536 |
| 4,722,618 | A | * | 2/1988 | Matsumoto et al. | 384/536 |
| 5,107,963 | A | * | 4/1992 | Rocca et al. | 187/410 |

(Continued)

FOREIGN PATENT DOCUMENTS

| | | | | |
|---|---|---|---|---|
| DE | WO 2009115316 A1 * | 9/2009 | ..... | F16F 1/3828 |
| JP | 56-132280 A | 10/1981 | | |

(Continued)

*Primary Examiner* — William A Rivera
*Assistant Examiner* — Michael Riegelman
(74) *Attorney, Agent, or Firm* — Sughrue Mion, PLLC

(57) ABSTRACT

An elevator car (1) which moves vertically along the hoistway is provided with a roller guide assembly (3) guided by a guide rail (2). The roller guide assembly (3) is provided with a horizontal fixing shaft (8) which is fixed to a base member (6) and rollers (5*a*, 5*b*, 5*c*) which are supported by the horizontal fixing shaft (8). The rollers (5*a*, 5*b*, 5*c*) are each provided with a roller outer circumference section (10), a rolling bearing (9), an annular rubber (11), and an inner cylinder (12). The configuration eliminates the need for a conventional spring or a conventional damper mechanism because the rubber (11) deforms elastically.

12 Claims, 8 Drawing Sheets

(56) References Cited

U.S. PATENT DOCUMENTS

| | | | | |
|---|---|---|---|---|
| 5,314,255 | A * | 5/1994 | Schwerdt | 384/536 |
| 5,950,771 | A | 9/1999 | Ferrisi et al. | |
| 6,032,764 | A | 3/2000 | Ferrisi et al. | |
| 6,062,347 | A * | 5/2000 | Traktovenko | 187/410 |
| 7,562,749 | B2 * | 7/2009 | Race et al. | 187/410 |
| 8,251,186 | B2 * | 8/2012 | Webster et al. | 187/409 |
| 8,573,850 | B2 * | 11/2013 | Reihle et al. | 384/536 |
| 2002/0131660 | A1 * | 9/2002 | Bade et al. | 384/536 |
| 2002/0172442 | A1 | 11/2002 | Bade et al. | |
| 2011/0091142 | A1 * | 4/2011 | Reihle | F16F 1/3828 384/456 |
| 2013/0068921 | A1 * | 3/2013 | Ikeda | 248/635 |

FOREIGN PATENT DOCUMENTS

| | | | |
|---|---|---|---|
| JP | 61-108276 | U | 7/1986 |
| JP | 63-159329 | U | 10/1988 |
| JP | 08-245119 | A | 9/1996 |
| JP | 2002-323042 | A | 11/2002 |
| JP | 2005-024051 | A | 1/2005 |
| JP | 2007-263350 | A | 10/2007 |
| JP | 4050466 | B2 | 2/2008 |

* cited by examiner

ELEVATOR DEVICE AND ROLLER GUIDE ASSEMBLY

CROSS REFERENCE TO RELATED APPLICATIONS

This application is a National Stage of International Application No. PCT/JP2012/066227, filed Jun. 26, 2012, claiming priority based on Japanese Patent Application No. 2011-149628, filed Jul. 6, 2011, the contents of all of which are incorporated herein by reference in their entirety.

TECHNICAL FIELD

This invention relates to a roller guide assembly of an elevator device arranged to guide an elevator car along a guide rail, and more specifically to an improvement of a roller rolled on the guide rail.

BACKGROUND ART

A general elevator device includes a driving means arranged to move an elevator car in an upward direction and in a downward direction along a hoistway, and a guide means arranged to stably move the elevator car in the upward direction and in the downward direction is so that the elevator car is not deviated from an appropriate position in the plane surface, and is not inclined. For example, the guide means includes a pair of guide rails disposed within the hoistway along the upward and downward directions, and roller guide assemblies which correspond to the respective guide rails, and which are disposed, respectively, at positions above and below the elevator car. Each of the roller guide assemblies includes a plurality of rollers arranged to be rolled on a plurality of guide surfaces of the guide rails.

There is known a conventional elevator device of, for example, a patent document 1. This elevator device includes a pair of guide rails disposed in the hoistway in the vertical direction. The roller guide assemblies are provided at upper and lower two portions of the guide rails. The roller guide assemblies are disposed on a left side and a right side of the elevator car. The elevator car is provided with four roller guide assemblies. Each of the roller guide assemblies includes three rollers engaged with the guide rail. Each of the roller guide assemblies is provided to be swung in the horizontal direction. That is, a rotation shaft is rotatably provided on the base. A base end portion of a lever arm protruding in the upward direction is connected to one end of the rotation shaft. Each of the rollers is rotatably supported at a tip end portion of this lever arm through an arm end and a roller shaft. These rollers are urged toward the guide rail by a suspension assembly including a spring. Moreover, a friction damping sub-assembly is provided, as a damper, at the other end of the rotation shaft.

In this conventional structure a swinging mechanism for supporting the rollers to be swung is needed for providing the suspension sub assembly (the urging mechanism) and the friction damping sub assembly (the damper), even though the movable size of the roller urged toward the guide rail is small. The structure of this swinging mechanism is complicated. Moreover, this needs much space. Moreover, two shafts of a roller shaft directly supporting rollers, and a rotation shaft for swinging the roller in the horizontal direction, and bearings for these two shafts are needed. A cost of components constituting the swinging mechanism is high.

It is an object of the present invention to provide a roller guide assembly and an elevator car which do not need a swinging mechanism, an urging mechanism, and a damper.

PRIOR ART DOCUMENT

Patent Document 1: U.S. Pat. No. 4,050,466

SUMMARY OF THE INVENTION

The roller guide assembly according to the present invention includes a plurality of horizontal fixing shafts disposed adjacent to a guide rail, and rollers rotatably supported, respectively, by the horizontal fixing shafts, and rolled on the guide rail.

Each of the rollers includes a roller outer circumference portion abutted on the guide rail, a bearing provided on an inner circumference side of (radially inside) the roller outer circumference portion, and an annular elastic member disposed between the bearing and the horizontal fixing shaft.

In the present invention, the annular elastic member is positioned within the bearing. The elastic member is disposed between the horizontal fixing shaft and the bearing. Each of the rollers is assembled in a state where the each of the rollers is pressed and abutted on the guide rail by an appropriate precompression. When a horizontal force is acted from the guide rail to the roller, the roller outer circumference portion and the bearing are relatively moved in the horizontal direction with respect to the horizontal fixing shaft, so that a portion of the elastic member on the guide rail's side is compressed. When the force is not acted from the guide rail, the compressed elastic member is likely to be returned to the initial state. That is, the roller outer circumference portion and the bearing are elastically moved in the horizontal direction with respect to the horizontal fixing shaft, and returned to the original position. When the roller is moved across and over the stepped portion of the connection portion of the guide rail, the vibration of the elevator car is suppressed since the roller outer circumference portion and the bearing are urged toward the guide rail by the precompression of the elastic member. When the elevator car receives the offset (unbalanced) load by the offset (unbalanced) position of the load (embarkation), the inclination of the elevator car is suppressed since the elevator car is supported by the guide rail in a state where the elastic member is compressed. Then, when the elastic load is not acted, the elastic member is returned to the initial state. Accordingly, the elastic member has an urging function which urges the roller outer circumference portion and the bearing toward the guide rail, a damper function which suppresses the repeat of the reciprocating movement of the urged roller outer circumference portion and the urged bearing in the urging direction, and a bearing function which supports the roller outer circumference portion and the bearing.

In one preferred embodiment, an inner cylinder is provided on the inner circumference side of (radially inside) the elastic member. The horizontal fixing shaft is inserted into the inner cylinder. The inner cylinder is made from hard material such as a metal.

For example, the inner cylinder is mounted and fixed in the annular elastic member to form an intermediate component. Next, the intermediate component is inserted within the bearing by the press-fit. With this, it is possible to assemble the roller. Alternatively, the elastic member may be directly inserted between the bearing and the inner cylinder by the press-fit to assemble the roller. Alternatively, the elastic member may be molded between the bearing and the inner cylinder. The inner cylinder is fixed to the horizontal fixing shaft through a nut and so on. The inner cylinder may be rotated with respect to the horizontal fixing shaft. The inner circumference portion of the elastic member is supported through the inner cylinder to the horizontal fixing shaft. With this, the support of the elastic member is stabilized.

More preferably, an outer cylinder is disposed between the elastic member and the bearing. The outer cylinder is made from hard material such as the metal.

For example, the elastic member is molded (cure adhesive) between the inner cylinder and the outer cylinder to form an intermediate component. The roller can be assembled by inserting the intermediate component within the bearing by the press-fit. Alternatively, the elastic member differently molded may be inserted between the inner cylinder and the outer cylinder by the press-fit. The outer cylinder is inserted, for example, on the inner circumference of the inner wheel of the bearing. The inner side and the outer side of the intermediate component is covered with the hard material such as the metal. Accordingly, the handling becomes easy.

Moreover, in another embodiment of the present invention, the deformation of the elastic member in the radial direction is restricted to a predetermined amount. That is, protruding portions protruding in the both axial directions are formed at a member (for example, the inner wheel of the bearing and the outer cylinder, or an additionally provided member) which is located radially outside the elastic member, and radially inside the roller outer circumference portion. A pair of the stoppers supported around the horizontal fixing shaft which is a center are provided on the both sides of the roller in the axial direction. Each of the stoppers includes a stopper portion which is formed on an outer circumference portion of a confronting surface of the stopper which confronts the roller to protrude in the axial direction, and which is arranged to restrict the movement of the protruding portions in the radially outward direction. Moreover, there is provided a positioning means arranged to position the pair of the stoppers to predetermined axial positions with respect to the rollers.

By this structure, when the horizontal force is acted from the guide rail to the roller, the bearing and the roller outer circumference portion are moved in the horizontal direction with respect to the horizontal fixing shaft by the elastic deformation of the elastic member. Then, when this displacement in the radial direction reaches a predetermined amount, the protruding portion is abutted on the inner circumference surface of the stopper, so that the deformation of the elastic member is restricted. Then, when the horizontal force from the guide rail is further increased, the load is acted only to the roller outer circumference portion made from the elastic material such as the rubber and the synthetic resin which have the relatively large hardness relative to the elastic member. Accordingly, this roller outer circumference portion is compressed in the radial direction. Accordingly, the vibration is absorbed by the elastic deformation of the elastic member which has the relatively small hardness. Consequently, the good ride quality is held. Moreover, the excessive large displacement by the elastic member is restricted at the operation of the emergency stop device. Therefore, it is possible to keep the elevator car to the stable posture.

It is desirable that the fixing position of the horizontal fixing shaft with respect to the base member can be adjusted in the radial direction of the roller so that the roller is pressed and abutted on the guide rail by the predetermined precompression. It is sufficient that the positioning mechanism can perform the slight amount of the positioning. The horizontal fixing shaft is fixed in a state where the positioning is performed. Accordingly, the device becomes simpler relative to the conventional structure in which the spring and the damper are provided.

In the present invention, the annular elastic member is merely disposed between the horizontal fixing shaft and the bearing without providing the swinging mechanism, the spring, and the damper like the conventional device. With this, it is possible to obtain a state where the roller is urged toward the guide rail, and to decrease the installation space of the component relative to the conventional device. Moreover, the annular elastic member is merely disposed between the horizontal fixing shaft and the bearing. Accordingly, it is possible to decrease the manufacturing cost of the roller guide assembly and the elevator device, relative to the conventional device. Moreover, the annular elastic member is merely disposed between the horizontal fixing shaft and the bearing. Accordingly, it is possible to decrease the manufacturing cost of the roller guide assembly and the elevator device, relative to the conventional device. Moreover, by varying the spring constant by varying the hardness of the elastic member, it is possible to meet the request for preventing the various vibration according to the difference of the structure of the elevator, and the speed of the elevator. Furthermore, when the roller outer circumference portion and the elastic member are worn and deteriorated over time, the exchange of the roller is only needed. The disassembly, the assembly, and the adjustment of the other peripheral portions are not needed. Accordingly, it is possible to decrease the time for the maintenance.

DESCRIPTION OF EMBODIMENTS

Hereinafter, embodiments of an elevator device and a roller guide assembly according to the present invention are illustrated in detail with reference to the drawings.

First, an overall structure of the elevator device is illustrated.

Figure 1:
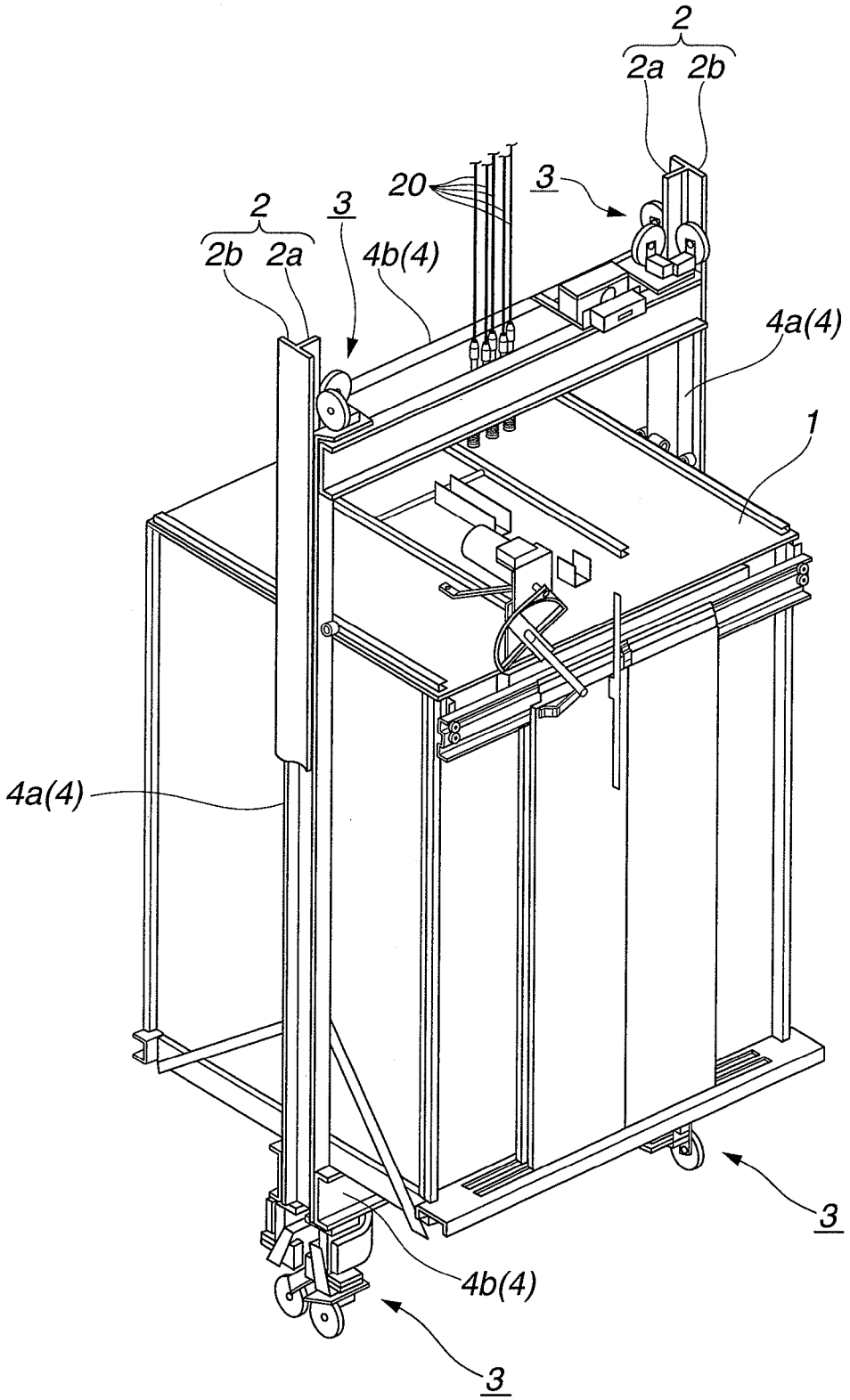
FIG. 1 is a perspective view showing an overall structure of an elevator device.

As shown in FIG. 1, a hoistway (not shown) is formed within a building in a vertical direction. There is provided an elevator car 1 which goes up or down along the hoistway. The elevator car 1 is suspended by ropes 20 to go up or down. A counterweight (not shown) is suspended at the other ends of the ropes 20. The both weights are balanced. Moreover, there are provided a pair of guide rails 2, 2 which are located at side positions of the elevator car 1 along the hoistway, and which are arranged to guide the elevator car 1 going up or down. A pair of upper and lower roller assemblies 3 are provided to each of the guide rails 2. The upper and lower roller assemblies 3 are located near upper and lower side surfaces of the elevator car 1, and arranged to guide the elevator car 1 along the guide rails 2, 2.

Each of the guide rail 2 includes a rail main body 2*a* protruding within the hoistway, and a base portion 2*b* fixed to a wall surface of the hoistway. With this, the guide rail 2 has a substantially T-shaped cross section. The pair of the guide rails 2, 2 are disposed within the hoistway in a state where the rail main bodies 2*a* of the guide rails 2, 2 confront each other.

On the other hand, an elevator car frame 4 is provided to the elevator car 1 so as to surround the elevator car 1 from the side directions of the elevator car 1 and the upward and downward directions of the elevator car 1. The elevator car frame 4 includes a pair of left and right longitudinal frames 4*a*, two upper frames 4*b*, and two lower frames 4*b*. The pair of the left and right longitudinal frames 4*a* and the lower frames 4*b* are disposed along the side surfaces and the lower surface of the elevator car 4. The upper frames 4*b* are provided at positions slightly away from an upper surface of the elevator car 1. The longitudinal frames 4*a*, the upper frames 4*b*, and the lower frames 4*b* are channel-shaped members, respectively. The two upper frames 4*b* and the two lower frames 4*b* are joined to sandwich the left and right longitudinal frames 4*a* respectively.

Figure 2:
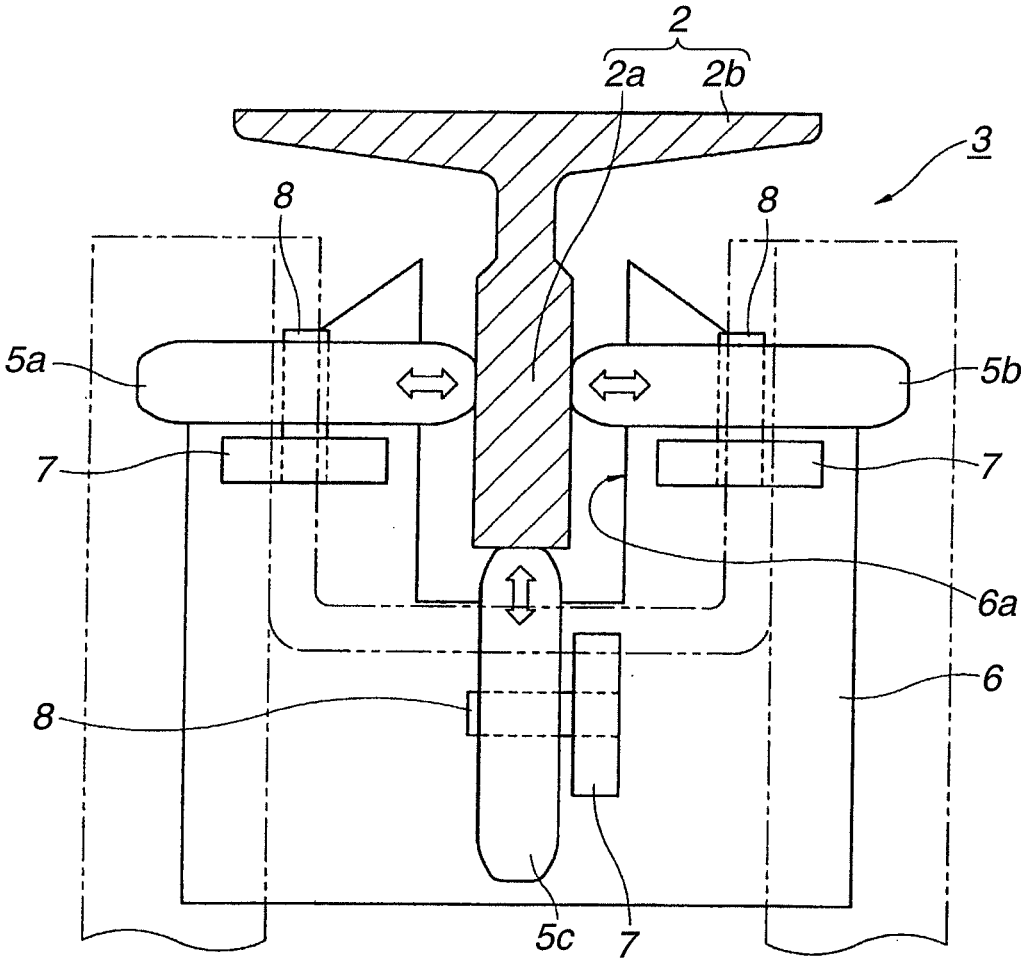
FIG. 2 is a plan view showing a roller guide assembly.
Figure 3:
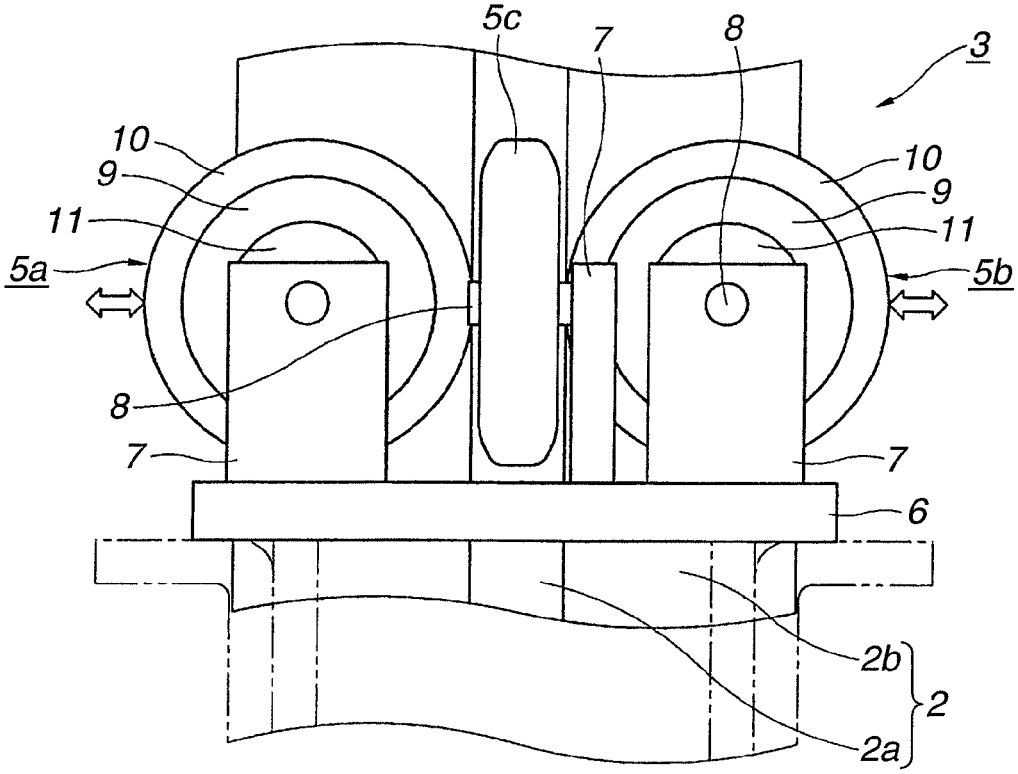
FIG. 3 is a front view showing the roller guide assembly.
Figure 4:
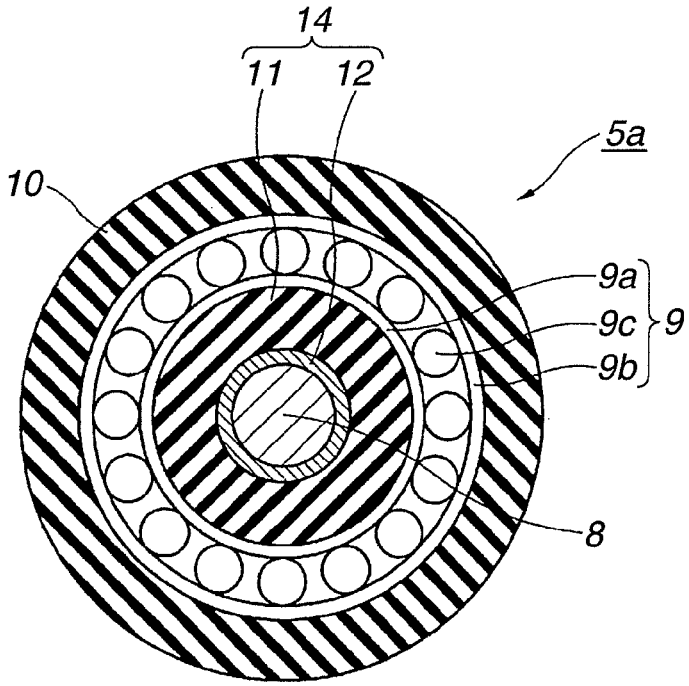
FIG. 4 is a sectional view showing a roller according to a first embodiment.

The roller guide assemblies 3 are mounted, respectively, to both end portions of the two upper frames 4*b* and the two lower frames 4*b*. As shown in FIG. 2 and FIG. 3, each of the roller guide assemblies 3 includes a pair of rollers 5*a*, 5*b* disposed to sandwich the rail main body 2*a* of the guide rail 2 from the both sides, and arranged to be rolled on the side surfaces of the rail main body 2*a*, and a roller 5*c* disposed to confront a top surface of the rail main body 2*a*, and arranged to be rolled on the top surface of the rail main body 2*a*. In the pair of the left and right guide rails 2, the top surfaces of the rail main bodies 2*a* corresponding to the rollers 5*c* confront each other. In this way, sets of three rollers 5*a*, 5*b* and 5*c* are provided at four portions of the elevator car 1. With this, the deviation of the position of the elevator car 1 in the plane surface, and the inclination of the elevator car 1 in the upward and downward directions and in the leftward and rightward directions are restricted.

A structure of the roller guide assembly 3 is more specifically illustrated. As shown in FIG. 2, plate-shaped base members 6 are joined to end portions of the upper frames 4*b* or the lower frames 4*b* of the elevator car frame 4. The base member 6 includes a cutaway portion 6*a* in which the rail main body 2*a* of the guide rail 2 is inserted. This cutaway portion 6*a* corresponds to a sectional shape of the longitudinal frame 4*a* of the elevator car frame 4.

Shaft support members 7 corresponding to the rollers 5*a*, 5*b*, and 5*c* are disposed on the base member 6 in the upright position. A horizontal fixing shaft 8 is mounted to each of the shaft support members 7 to protrude from the each of the shaft support members 7. The horizontal fixing shafts 8 are adjacent to the guide rails 2. The horizontal fixing shafts 8 extend, respectively, in parallel with the side surfaces and the top surface of the rail main body 2*a* on which the rollers 5*a*, 5*b*, and 5*c* are abutted. The rollers 5*a*, 5*b*, and 5*c* are supported by these horizontal fixing shafts 8.

Next, structures of the rollers 5*a*, 5*b*, and 5*c* in the first embodiment are illustrated in detail with reference to FIG. 1. The rollers 5*a*, 5*b*, and 5*c* have the same structure. Accordingly, the roller 5*a* is illustrated below.

The roller 5*a* includes a roller outer circumference portion 10 which has an annular shape, and which is abutted on the rail main body 2*a*, a bearing 9 which is provided on the inner circumference side of (radially inside) the roller outer circumference portion 10, an elastic member such as a rubber 11 which has an annular shape, and which is provided on an inner circumference side of (radially inside) the bearing 9, and an inner cylinder 12 which is made from a metal, and which is provided on the inner circumference side of (radially inside) the rubber 11. The horizontal fixing shaft 8 is inserted into the inner cylinder 12. For example, a screw (not shown) is formed at a tip end portion of the horizontal fixing shaft 8. The inner cylinder 12 is fixed to the horizontal fixing shaft 8 by a nut (not shown) which is screwed onto this screw. The roller outer circumference portion 10 is made from material which has an elasticity, such as rubber or a synthetic resin (for example, urethane). The hardness of the outer circumference portion 10 made from this elastic material is set larger than the hardness of the rubber 11. That is, the roller outer circumference portion 10 is harder than the rubber 11.

The bearing 9 is a general ball bearing. The bearing 9 includes a plurality of steel balls 9*c* which are disposed between an inner wheel 9*a* and an outer wheel 9*b* that are made from the metal. Besides, a roller bearing may be used in place of this ball bearing. The rubber 11 is disposed on the inner circumference of the inner wheel 9*a*. The roller outer circumference portion 10 can be rotated through this bearing 9 with respect to the inner cylinder 12 and the rubber 11.

There are two methods for disposing the inner cylinder 12 and the annular rubber 11 between the horizontal fixing shaft 8 and the bearing 9. In one of the two methods, the rubber 11 is adhered to the outer circumference of the inner cylinder 12 by the baking adhesive to form an intermediate component 14, and then the intermediate component 14 is inserted in the inner circumference side of (radially inside) the bearing 9 (that is, the inner wheel 9*a*) by the press-fit. In the other of the two methods, the rubber 11 molded into an annular shape is directly inserted between the bearing 9 and the inner cylinder 12 by the press-fit. Alternatively, the rubber 11 is molded between the bearing 9 and the inner cylinder 12, and then these are adhered by the cure adhesion.

In a state where the rollers 5*a*, 5*b*, and 5*c* are supported by the horizontal fixing shafts 8 and these are assembled as the roller guide assemblies 3 with respect to the guide rails 2, predetermined precompressions (preloads) are applied to the rubbers 11 of the rollers 5*a*, 5*b*, and 5*c*. That is, in the assembly state, a part of the rubber 11 which is on the guide rail 2's side is deformed to be compressed by a relatively small predetermined amount (for example, about 1 mm). The roller outer circumference portion 10 is pressed on the guide rail 2 by the predetermined load.

In this embodiment, the rubber 11 is disposed between the inner cylinder 12 and the bearing 9. Accordingly, when the horizontal force is acted from the guide rail 2 to the rollers 5*a*, 5*b*, and 5*c*, the roller outer circumference portion 10 and the bearing 9 are moved in the horizontal direction relative to the inner cylinder 12 constituting the rollers 5*a*, 5*b*, and 5*c*, so that a portion of the rubber 11 on the guide rail 2's side is compressed and deformed. Then, when the horizontal force from the guide rail 2 is not acted, the rubber 11 is returned to the initial state. That is, when the elevator car 1 is displaced with respect to the guide rail 2, the roller outer circumference portion 10 and the bearing 9 are moved in the horizontal direction with respect to the horizontal fixing shaft 8, and then returned to the original position. When the rollers 5*a*, 5*b*, and 5*c* are moved across and over a stepped portion of the connection portion of the guide rail 2, the vibration of the elevator car 1 is suppressed since the outer circumference portion 10 is urged toward the guide rail 2 by the precompression of the rubber 11. When the elevator car 1 receives the offset (unbalanced) load by the offset (unbalanced) position of the load (embarkation) within the elevator car 1, the inclination of the elevator car 1 is suppressed since the elevator car 1 is supported by the guide rails 2 in a state where the rubbers 11 are compressed. Then, when the offset (unbalanced) load is not acted, the rubbers 11 are returned to the initial state. Accordingly, the rubber 11 has an urging function which urges the roller outer circumference portion 10 and the bearing 9 toward the guide rail 2, a damper function which suppresses the vibration of the roller outer circumference portion 10 and the bearing 9 which are urged, and a bearing function which supports the roller outer circumference portion 10 and the bearing 9.

In this way, in this embodiment, the inner cylinder 12 and the rubber 11 are merely disposed between the horizontal fixing shaft 8 and the bearing 9 without providing the swinging mechanism and the urging means like the conventional device. With this, it is possible to obtain a state in which the rollers 5*a*, 5*b*, and 5*c* are urged toward the guide rail 2. Accordingly, it is possible to decrease the installation space of the components, relative to the conventional device. Moreover, the inner cylinder 12 and the annular rubber 11 are merely disposed between the horizontal fixing shaft 8 and the bearing 9, with respect to the conventional device in which the swinging mechanism, the urging means, and the damper are provided. Accordingly, it is possible to decrease the manufacturing cost of the elevator device and the roller guide assembly 3 relative to the conventional device. Furthermore, the spring constant is varied by varying the hardness of the rubber 11. With this, it is possible to meet a request for preventing the various vibrations according to the differences of the structure of the elevator and the speed of the elevator. Moreover, when the outer circumference portion 10 and the rubber 11 are worn away and deteriorated over time, the exchange of the rollers 5*a*, 5*b*, and 5*c* are only needed. The disassembly, the assembly, and the adjustment of the other peripheral portions are not needed. Accordingly, it is possible to reduce cut the time necessary for the maintenance. Moreover, the inner cylinder 12 is disposed between the rubber 11 and the horizontal fixing shaft 8. Accordingly, the inner circumference portion of the rubber 11 is supported through the inner cylinder 12 by the horizontal fixing shaft 8, so that the support of the rubber 11 is stabilized.

The roller outer circumference portion 10 is made from the elastic material such as the rubber or the urethane. However, the hardness of the roller outer circumference portion 10 is larger than the hardness of the rubber 11. Accordingly, the rubber 11 is mainly elastically deformed with respect to the relatively small load. By appropriately setting a combination of the hardness (the spring constants) of the roller outer circumference portion 10 and the rubber 11, the vibration of the elevator car is suppressed by the elastic deformation of the rubber 11 in the normal operation. On the other hand, when the elevator car 1 is stopped by the operation of the emergency stop device, the roller outer circumference portion 10 is bent by the large load. Consequently, the shock acted to the rollers 5*a*, 5*b*, and 5*c* is alleviated.

Next, a second embodiment of the rollers 5*a*, 5*b*, and 5*c* is illustrated. Besides, the same numerals are added to portions identical to the rollers of the first embodiment, and the illustration is omitted. The only different portions are illustrated.

Figure 5:
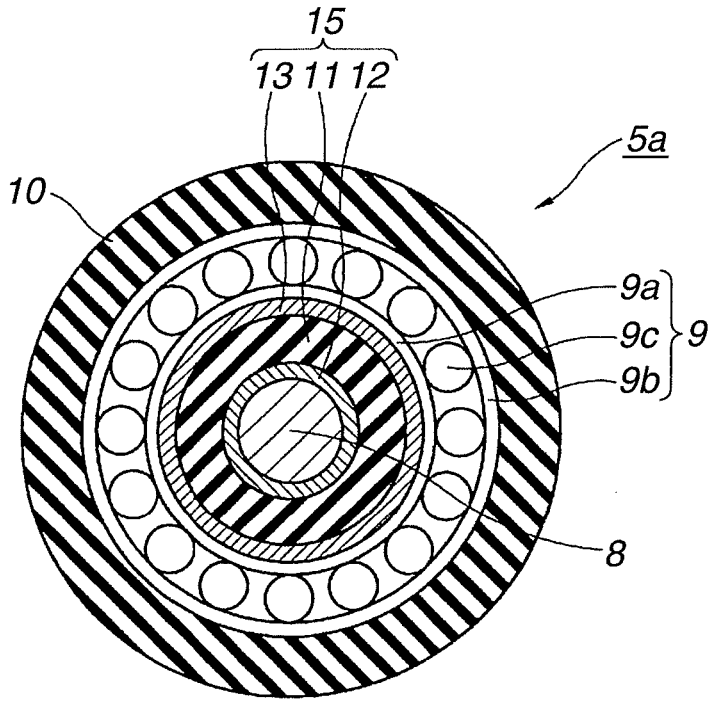
FIG. 5 is a sectional view showing a roller according to a second embodiment.

In the second embodiment, as shown in FIG. 5, an outer cylinder 13 is provided on the outer circumference portion of (radially outside) the rubber 11. That is, there are provided the inner cylinder 12 which is made from the metal, and into which the horizontal fixing shaft 8 is inserted, and the outer cylinder 13 which is made from the metal, and which is mounted in the bearing 9. In one example, the rubber 11 is molded (cure adhesion) between the inner cylinder 12 and the outer cylinder 13 to form an intermediate component 15. This intermediate component 15 is inserted, by the press-fit, on the inner circumference side of (radially inside) the bearing 9, that is, the inner wheel 9*a*. The rubber 11 may be formed into the annular shape, and this rubber 11 may be inserted between the inner cylinder 12 and the outer cylinder 13 by the press-fit to form the intermediate component 15.

In this embodiment, both of the inner circumference side and the outer circumference side of the intermediate component 15 are covered with the metal. Accordingly, it is possible to easily handle this. Moreover, the manufacturing process of the roller is simplified.

Next, a third embodiment of the rollers 5*a*, 5*b*, and 5*c* are illustrated with reference to FIG. 6 to FIG. 8.

In this third embodiment, the maximum displacement of the rubber 11 in the radial direction is mechanically restricted. As shown in FIG. 6, the inner wheel 9*a* of the bearing 9 extends in the both axial directions to form protruding portions 9*d* which are located at both ends of the inner wheel 9*a*, and which protrude in the side directions relative to the outer wheel 9*b*. There are provided a pair of stoppers 16 which have disc shapes, which are disposed on the both sides of the roller 5*a* in the axial direction, and which cover the side surfaces of the bearing 9. Each of these stoppers 16 includes a central hole into which the horizontal fixing shaft 8 is inserted. With this, the each of these stoppers 16 is supported with the roller 5*a* by the horizontal fixing shaft 8. Each of the stoppers 16 includes a stopper portion 16*a* which is formed on an outer circumference portion of a confronting surface of the each of the stoppers 16 which confronts the roller 5*a* (the bearing 9), which protrudes in the axially inward direction, and which is arranged to be engaged with the protruding portion 9*d*. This stopper portion 16*a* is engaged with the protruding portion 9*d* when the rubber 11 is displaced by a predetermined amount, so as to restrict the movement of the protruding portion 9*d* in the radially outward direction. Furthermore, the inner cylinder 12 extends in the both axial directions as a positioning means arranged to position the pair of the stoppers 16 to a predetermined axial position with respect to the roller 5*a*. The inner cylinder 12 protrudes form the side surfaces of the rubber 11 by the predetermined amounts. With this, the pair of the stoppers 16 are positioned so as not to be abutted on the protruding portions 9*d* in the axial direction.

By this third embodiment, when the horizontal force is acted from the guide rail 2 to the rollers 5*a*, 5*b*, and 5*c*, the bearing 9 and the roller outer circumference to portion 10 are moved in the horizontal direction with respect to the horizontal fixing shaft 8. Accordingly, the portion of the rubber 11 on the guide rail 2's side is compressed and deformed. In this case, when the deformation amount of the rubber 11 reaches a is predetermined amount, the outer circumference surface of the protruding portion 9 which are formed in each of the rollers 5*a*, 5*b*, and 5*c* are abutted on the inner circumference surface of the stopper portion 16*a*, as shown in FIG. 7. With this, the deformation of the rubber 11 is restricted. When the horizontal force from the guide rail 2 is further increased, the load is acted only to the roller outer circumference portion 10 which is made from the elastic material having the large hardness, so that the roller outer circumference portion 10 is compressed.

Figure 6:
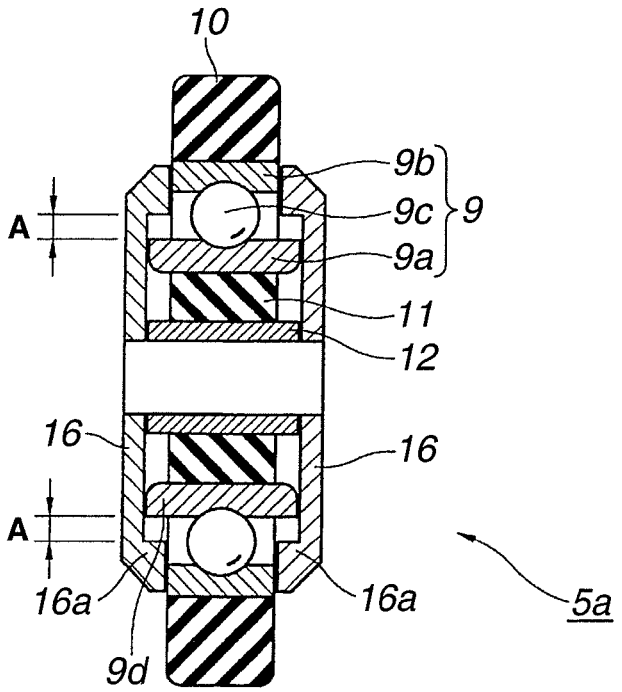
FIG. 6 is a sectional view showing a roller according to a third embodiment.
Figure 7:
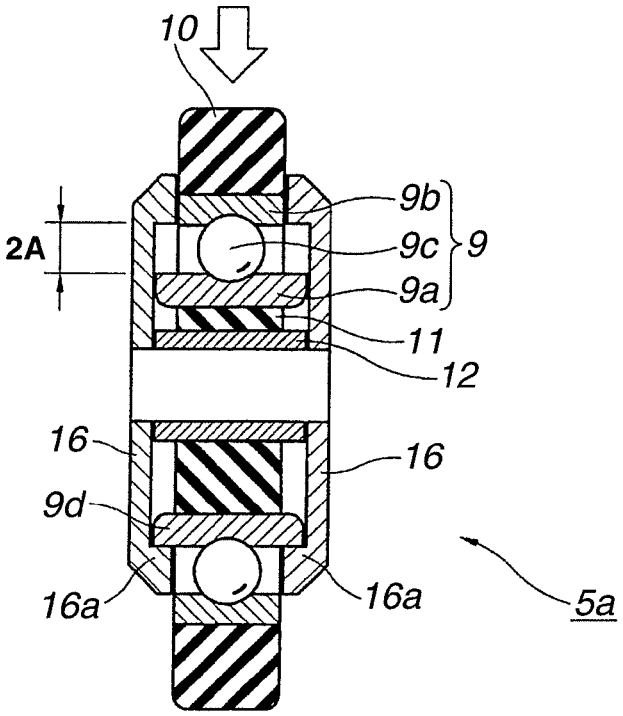
FIG. 7 is an illustrative view showing a state in which the roller of the third embodiment is applied with a load.

That is, in the initial state, the distance between the outer circumference surface of the inner wheel 9*a* of the bearing 9 and the inner circumference surface of the stopper portion 16*a* is a distance "A" all over the circumference, as shown in FIG. 6. When the large horizontal load is acted to the rubber 11 as shown by an arrow in FIG. 7 and the rubber 7 is compressed only by the distance "A" in the radial direction, the protruding portions 9*d* of the inner wheel 9 are abutted on the stopper portions 16*a*, so as to restrict the further displacement. That is, when the rubber 11 is compressed by the compression amount "A" in the radial direction, the rubber 11 is not further compressed. Accordingly, when the load is further increased, the roller outer circumference portion 10 is compressed, so that the deformation of the roller outer circumference portion 10 is only increased.

Figure 8:
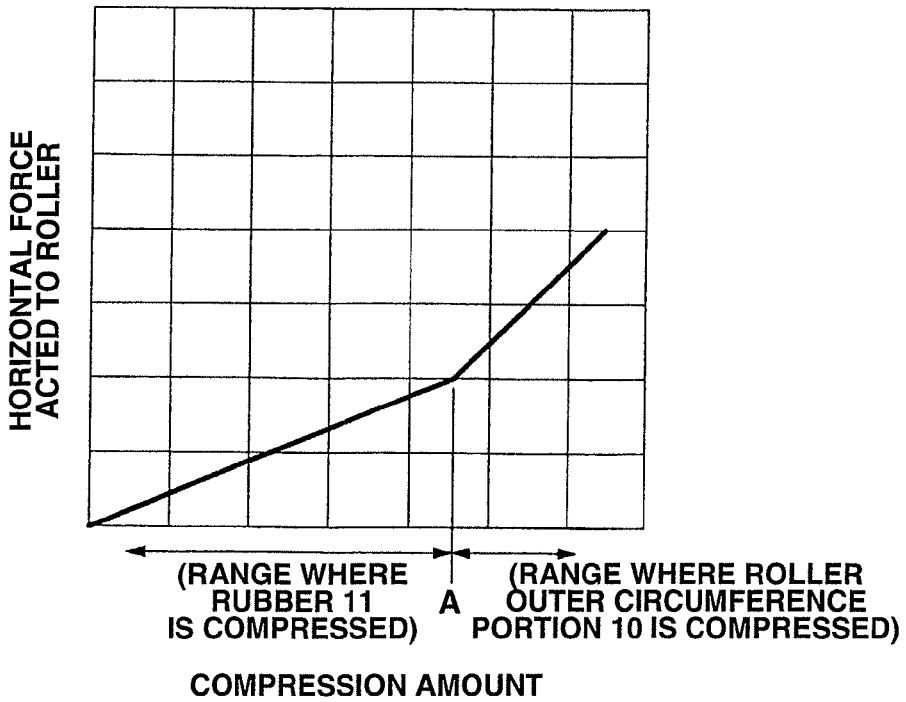
FIG. 8 is a graph showing a relationship between a compression amount and a horizontal force which is acted to the roller of the third embodiment.

FIG. 8 shows this variation of the compression amount. When the elevator car 1 goes up or down in the normal state or the offset (unbalanced) load is acted, the rubber 11 having the small hardness is compressed in a range in which the compression amount is from "0" to "A". Accordingly, it is possible to obtain the good ride quality. Then, when the emergency stop device is acted and the large load is acted to the rollers 5*a*, 5*b*, and 5*c*, the rubber 11 is not compressed by the compression amount "A" or more, the roller outer circumference portion 10 having the relatively large hardness is compressed. Accordingly, the shock acted to the elevator car 1 is alleviated by the elasticity of the roller outer circumference portion 10. On the other hand, the operation of the emergency stop device is stably performed. That is, it is possible to stably stop the elevator car 1 at the operation of the emergency stop device.

Besides, in the above-described embodiments, the rubber 11 is provided with the inner cylinder 12 or the outer cylinder 13 which are made from the metal. However, the only rubber 11 may be provided on the inner circumference side of the inner wheel 9*a* of the bearing 9.

Moreover, in the third embodiment shown in the drawing, the protruding portions 9*d* are formed at the both end portions of the inner wheel 9*a*. In place of this, the outer wheel 9*b* may be extended in the axial direction to form the protruding portions which are located at the both end portions of the outer wheel 9*b*. Furthermore, in the structure in which the outer cylinder 13 is provided like the second embodiment, the outer cylinder 13 may be extended in the axial direction to form the protruding portions which are located at the both end portions of the outer cylinder 13, in place of the inner wheel 9*a*. Moreover, in a case in which the only rubber 11 is disposed between the bearing 9 and the horizontal fixing shaft 8 without providing the inner cylinder 12 to form the roller, a sleeve which is a different member, and which has a length identical to that of the inner cylinder 12 in FIG. 6 is disposed, as the positioning means, between the horizontal fixing shaft 8 and the rubber 11.

Figure 9:
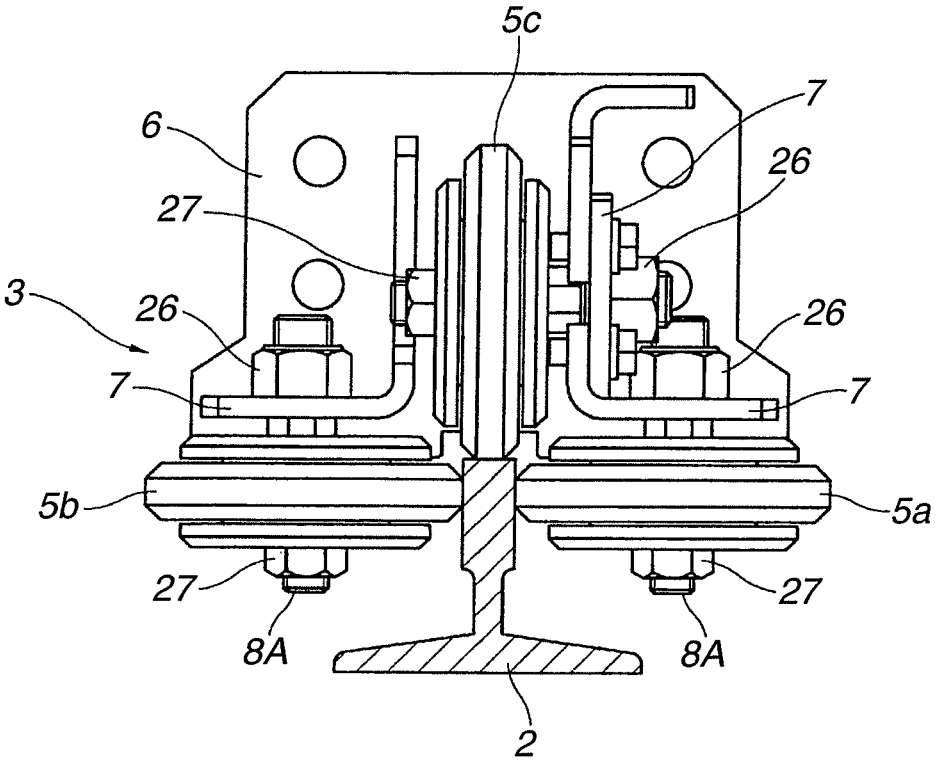
FIG. 9 is a plan view showing the roller guide assembly for showing one example of a positioning mechanism for applying a precompression.
Figure 10:
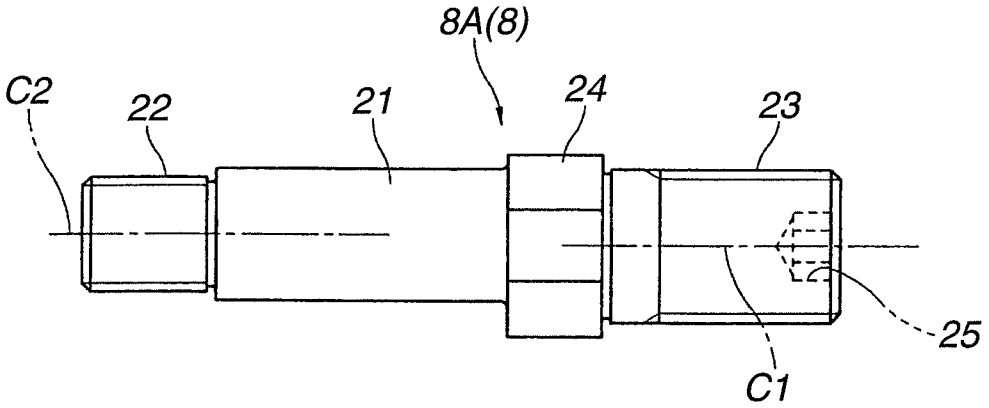
FIG. 10 is a plan view showing an eccentric type horizontal fixing shaft which is used in the positioning mechanism.

Next, FIG. 9 and FIG. 10 show one example of the adjusting mechanism arranged to adjust the fixing position of the horizontal fixing shaft 8 for setting the precompression of the rollers 5*a*, 5*b*, and 5*c*. In this example, an eccentric type horizontal fixing shaft 8A shown in FIG. 10 is used as the horizontal fixing shaft 8. This eccentric type horizontal fixing shaft 8A includes a roller support shaft portion 21 on which the center holes (for example, the inner cylinder 12) of the rollers 5*a*, 5*b*, and 5*c* are mounted, a screw shaft portion 22 which is formed at a tip end of the roller support shaft portion 21, a mounting shaft portion 23 which is located on a side opposite to this screw shaft portion 22, and a hexagonal portion 24 which is positioned between this mounting portion 23 and the roller support shaft portion 21. The mounting shaft portion 23 includes a hexagonal hole 25 which is formed on an end surface of the mounting shaft portion 23, and which is for a hexagonal wrench. Moreover, the mounting shaft portion 23 includes a screw portion 23*a* to which is formed on an outer circumference surface of the mounting shaft portion 23. A center axis C1 of the mounting shaft portion 23 and the hexagonal portion 24 is eccentric from a center axis C2 of the roller support shaft portion 21 and the screw shaft portion 22 by a is predetermined amount (for example, about 1 mm).

The shaft support member 7 is stood in the upright position on the base member 6 of the roller guide assembly 3. The shaft support member 7 includes a circular hole into which the mounting shaft portion 23 is inserted. As shown in FIG. 9, the eccentric type horizontal fixing shaft 8A is fixed, respectively, to the shaft support member 7 by a nut 26 screwed on the screw portion 23*a* and the hexagonal portion 24. The rollers 5*a*, 5*b*, and 5*c* are supported on the roller support shaft portion 21, and moreover held by a nut 27 screwed on the screw shaft portion 22.

As described above, the roller support shaft portion 21 and the mounting shaft portion 23 are eccentric with each other. Accordingly, the rotation centers of the rollers 5*a*, 5*b*, and 5*c* with respect to the guide rail 2 are varied by varying the angle position of the mounting shaft portion 23. In particular, when the eccentric type horizontal fixing shaft 8A is fixed to the shaft support member 7 by the nut 26, the eccentric type horizontal fixing shaft 8A is rotated by using the hexagonal wrench (not shown) engaged with the hexagonal hole 25. With this, the precompression with respect to the guide rail 2 is appropriately adjusted. When it becomes the optimum rotational position, the eccentric type horizontal fixing shaft 8A is fixed by the nut 26.

Figure 11:
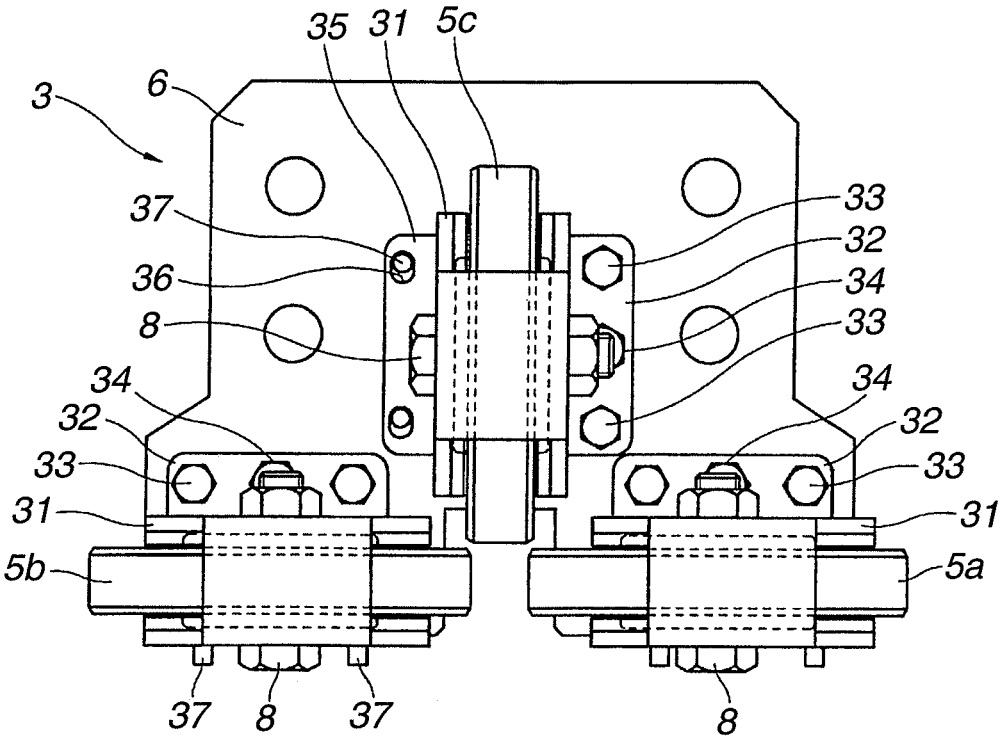
FIG. 11 is a plan view showing the roller guide is assembly for showing another example of a positioning mechanism.
Figure 12:
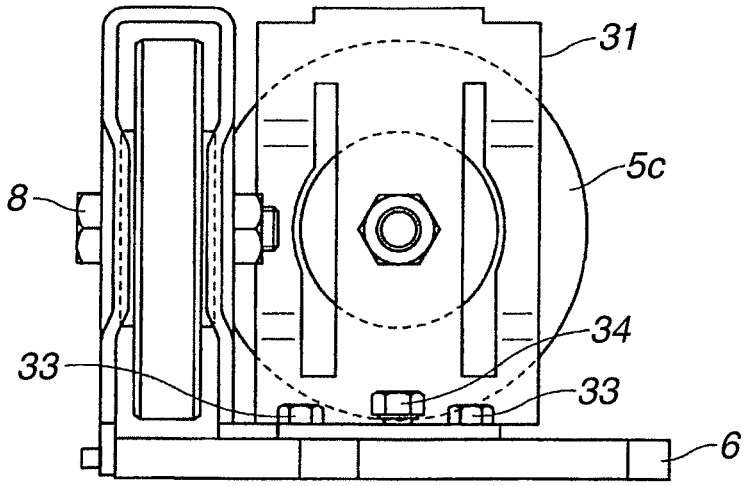
FIG. 12 is a side view showing the roller guide assembly.
Figure 13:
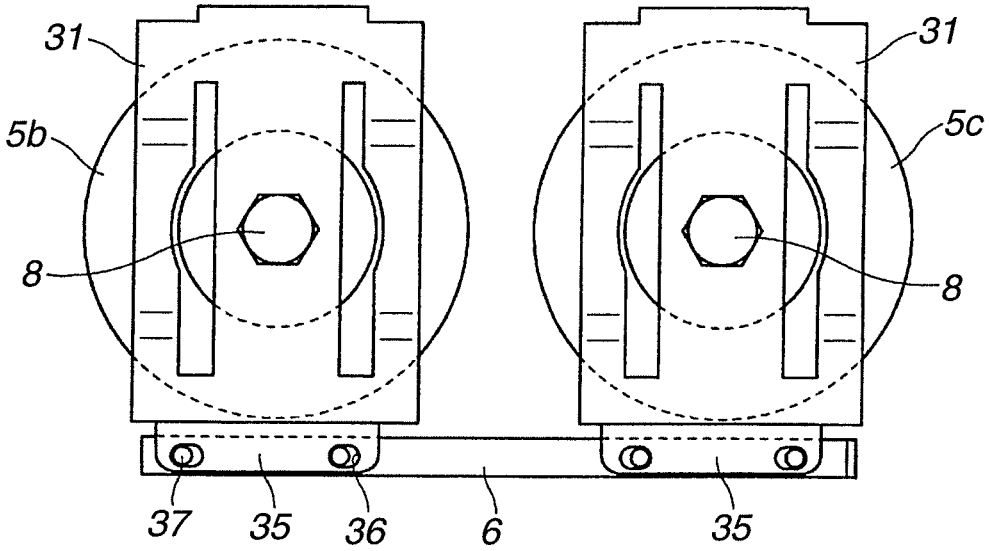
FIG. 13 is a front view showing a part of the roller guide assembly.

Next, another example of the adjusting mechanism arranged to adjust the fixing position of the horizontal fixing shaft 8 is illustrated with reference to FIG. 11 to FIG. 13. In this example, the rollers 5*a*, 5*b*, and 5*c* are supported by brackets 31 independently mounted on the base member 6. Accordingly, it is possible to adjust the positions of the brackets 31 with respect to the base member 6. Besides, the horizontal fixing shaft 8 is fixedly supported by each of the brackets 31. Each of the brackets 31 has a substantially U-shaped structure obtained by bending the metal sheet. A first flange 32 located on one end of the bracket 31 is fixed to the base member 6 by a pair of bolts 33 and a positioning bolt 34. A second flange 35 located on the other end of the bracket 31 includes a pair of guide holes 36 which have oval shapes. A guide pin 37 fixed to the base member 6 is engaged with the guide hole 36. In the brackets 31 for the pair of the rollers 5*a* and 5*b* which correspond to both side surfaces of the guide rail 2, the second flange 35 extends linearly along the end surface of the base member 6, the second flange 35 is engaged with a guide pin 37 provided on the end surface of the base member 6.

Figure 14:
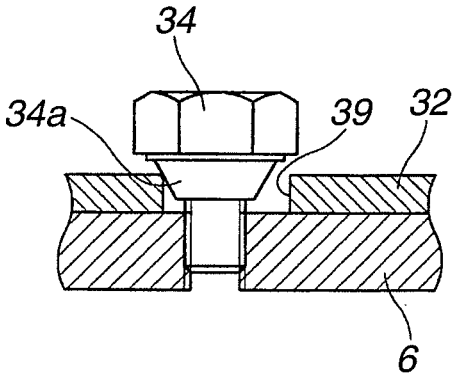
FIG. 14 is an illustrative view for illustrating a positioning bolt.

The first flange 32 includes a pair of holes (not shown) for the bolts 33, and a hole 39 for the positioning bolt 34. These holes have oval shapes extending in the radial direction of the rollers 5*a*, 5*b*, and 5*c*. As shown in FIG. 14, the positioning bolt 34 includes a taper portion 34*a* which is abutted on an opening edge of the hole 39. Accordingly, when the positioning bolt 34 is tightened in a state where the bolt 33 is loosened, the entire of the bracket 31 is moved in the radial direction of the rollers 5*a*, 5*b*, and 5*c*. The bracket 31 is fixed by the pair of the bolts 33 in a state where the appropriate precompression is applied to the rollers 5*a*, 5*b*, and 5*c*.

The invention claimed is:

1. An elevator device comprising:

an elevator car going up or down along a hoistway;

a guide rail which is disposed along the hoistway, and arranged to guide the elevator car to go up or down;

the elevator car including a roller guide assembly which is guided by the guide rail, the roller guide assembly including a plurality of horizontal fixing shafts disposed adjacent to the guide rail, and rollers which are rotatably supported by the respective horizontal fixing shafts, and which are arranged to be rolled on the guide rail, each of the rollers including a roller outer circumference portion made from elastic material, and abutted on the guide rail, a bearing provided on an inner circumference side of the roller outer circumference portion, and an elastic member which has an annular shape, which is disposed between the bearing and the horizontal fixing shaft, and which has a hardness relatively smaller than a hardness of the elastic material, a stopper section which includes a pair of stoppers which are located on both sides of the roller in an axial direction and are arranged to restrict a maximum displacement of the elastic member in a radial direction, to a predetermined amount, wherein the stopper section further comprises a protruding portion which is located radially outside the elastic member in the radial direction, and radially inside the roller outer circumference portion in the radial direction, and which protrudes in the axial direction, and the pair of stoppers are supported around the horizontal fixing shaft which is a center; the stopper section includes a stopper portion which is located on an outer circumference portion of at least one stopper of the pair of stoppers that faces the roller, and which is arranged to restrict a movement of the protruding portion outwardly in the radial direction.

2. The elevator device defined in claim 1, wherein the elevator device further comprises an inner cylinder which is provided on the inner circumference side of the elastic member, and into which the horizontal fixing shaft is inserted.

3. The elevator device defined in claim 2, wherein an outer cylinder is disposed between the elastic member and the bearing.

4. The elevator device defined in claim 1, further comprising a positioning section arranged to position the pair of the stoppers with respect to the roller.

5. The elevator device defined in claim 1, wherein a fixing position of the horizontal fixing shaft with respect to a base member can be adjusted in the radial direction so that the roller is pressed and abutted on the guide rail by a predetermined precompression.

6. The elevator device defined in claim 1, wherein the stopper portion is configured to engage with the protruding portion as a result of the elastic material being displaced by the predetermined amount.

7. A roller guide assembly provided to an elevator car, and arranged to be guided by a guide rail in an elevator device including a hoistway formed in a vertical direction, the elevator car arranged to go up or down along the hoistway, and the guide rail disposed along the hoistway, the roller guide assembly comprising:

a plurality of horizontal fixing shafts disposed adjacent to the guide rail; and rollers rotatably supported by the respective horizontal fixing shafts, and arranged to be rolled on the guide rail;

each of the rollers including a roller outer circumference portion made from elastic material, and abutted on the guide rail, a bearing provided on an inner circumference side of the roller outer circumference portion, and an elastic member which has an annular shape, which is disposed between the bearing and the horizontal fixing shaft, and which has a hardness relatively smaller than a hardness of the elastic material, a stopper section which includes a pair of stoppers which are located on both sides of the roller in an axial direction and are arranged to restrict a maximum displacement of the elastic member in a radial direction, to a predetermined amount, wherein the stopper section further comprises a protruding portion which is located radially outside the elastic member in the radial direction, and radially inside the roller outer circumference portion in the radial direction, and which protrudes in the axial direction, and the pair of stoppers are supported around the horizontal fixing shaft which is a center; the stopper section includes a stopper portion which is located on an outer circumference portion of at least one stopper of the pair of stoppers that faces the roller, and which is arranged to restrict a movement of the protruding portion outwardly in the radial direction; and the roller guide assembly.

8. The roller guide assembly defined in claim 7, wherein the roller guide assembly further comprises an inner cylinder which is located on an inner circumference side of the elastic member, and into which the horizontal fixing shaft is inserted.

9. The roller guide assembly defined in claim 8, wherein an outer cylinder is disposed between the elastic member and the bearing.

10. The roller guide assembly defined in claim 7, further comprising a positioning section arranged to position the pair of the stoppers with respect to the roller.

11. The roller guide assembly defined in claim 7, wherein a fixing position of the horizontal fixing shaft with respect to the base member can be adjusted in the radial direction so that the roller is pressed and abutted on the guide rail by a predetermined precompression.

12. The roller guide assembly defined in claim 7, wherein the stopper portion is configured to engage with the protruding portion as a result of the elastic material being displaced by the predetermined amount.

* * * * *